US005810457A

United States Patent [19]

Felsenthal et al.

[11] Patent Number: 5,810,457

[45] Date of Patent: Sep. 22, 1998

[54] COLLAPSIBLE AND TAUTLY SUSPENDABLE SHELVING ASSEMBLY

[76] Inventors: Donald H. Felsenthal, 5999 Wood Trail Dr., Memphis, Tenn. 38120; Sandy A. Felsenthal, 5428 Collingwood Cove, Memphis, Tenn. 38117

[21] Appl. No.: 745,058

[22] Filed: Nov. 7, 1996

Related U.S. Application Data

[63] Continuation-in-part of Ser. No. 563,143, Nov. 27, 1995, Pat. No. 5,622,415.

[51] Int. Cl.[6] ..... B65D 85/18

[52] U.S. Cl. ..... 312/6; 312/351; 108/106

[58] Field of Search ..... 312/3, 4, 5, 6, 312/351; 108/106, 149, 96; 211/119, 117, 186, 187

[56] References Cited

U.S. PATENT DOCUMENTS

| | | | |
|---|---|---|---|
| 1,121,211 | 12/1914 | Vaughan | 312/5 |
| 2,440,192 | 4/1948 | Cowen | 312/6 |
| 2,483,043 | 9/1949 | Golden | 108/149 X |
| 2,556,105 | 6/1951 | Rhett | 108/106 |
| 2,639,819 | 5/1953 | Marks | 312/6 X |
| 3,184,273 | 5/1965 | Blough | 312/6 |
| 4,061,092 | 12/1977 | Jacosen et al. | 108/149 |
| 4,736,855 | 4/1988 | Arakawa | 108/149 X |
| 5,542,530 | 8/1996 | Freelander | 108/106 X |

FOREIGN PATENT DOCUMENTS

| | | | |
|---|---|---|---|
| 1129305 | 1/1957 | France | 312/5 |
| 1441450 | 5/1966 | France | 211/187 |

*Primary Examiner*—Peter M. Cuomo
*Assistant Examiner*—Janet M. Wilkens
*Attorney, Agent, or Firm*—Peter J. Georges

[57] ABSTRACT

Collapsible shelving that can be tautly suspended by a single person within an erected wardrobe frame is described. The shelving is comprised of eight hooks that engage top and bottom poles of the wardrobe frame, four cords that engage the hooks at each end, a plurality of staples attached to each of the cords, and a plurality of shelves that rest on the staples horizontally and in parallel with each other.

12 Claims, 2 Drawing Sheets

FIG. 2
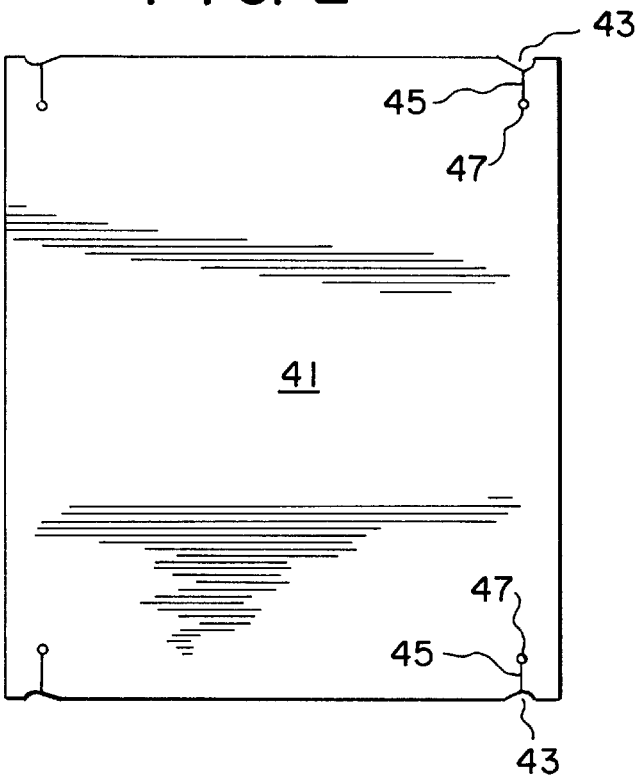
FIG. 3
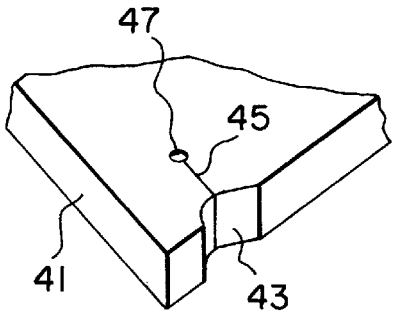
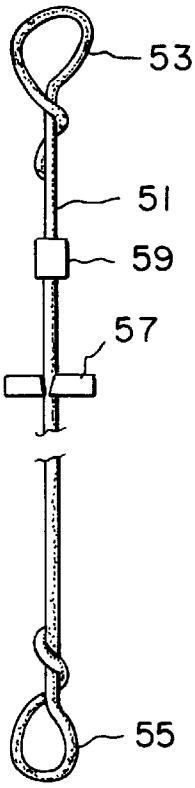
FIG. 4
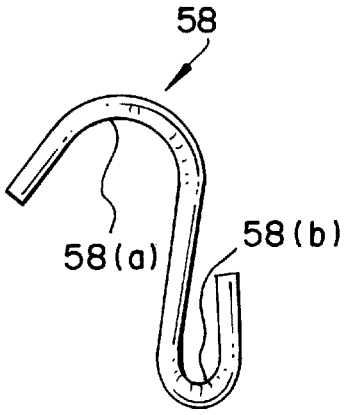
FIG. 5

COLLAPSIBLE AND TAUTLY SUSPENDABLE SHELVING ASSEMBLY

REFERENCE TO RELATED APPLICATION

This application is a continuation-in-part of Ser. No. 08/563,143, filed Nov. 27, 1995, now U.S. Pat. No. 5,622,415, of Donald H. Felsenthal et al., for "Portable Wardrobe Frame", the disclosure of which is incorporated herein by reference thereto.

BACKGROUND OF THE INVENTION

1. Field of the Invention

This invention relates to light, easily erectable, collapsible, and sturdy wardrobes, armoires, and storage closets and frames therefor that can be assembled and disassembled by a single person and especially relates to a collapsible shelving assembly that is tautly suspended within such a frame between the top and bottom members thereof.

2. Background of the Invention

Collapsible wardrobes, armoires, and storage closets have been known and used for many years. The wardrobe frame of the parent application comprises a hanging section and a shelf section and further comprises a plurality of molded connection pieces disposed at its top and bottom, a plurality of horizontally disposed holes that are inserted into holes in the connection pieces, a plurality of upright poles that are inserted into other holes in the connection pieces and have a spaced array of holes, and a plurality of shelves having an attachment means at each corner for selectively attaching the shelves to the poles by insertion of the attachment means into the spaced array of holes, thereby forming the shelf section.

Collapsible shelving that is suspended from an overhead support has been in use for many years. Sweater bags, for example, have been on the market with such suspended and collapsible shelving therewithin.

U.S. Pat. No. 2,639,819 relates to a container in the form of a flexible walled body having means for collapsibly supporting a plurality of horizontal shelves having triangular brackets at their corners for engaging vertical supporting rods.

U.S. Pat. No. 4,061,092 discloses a device comprising four clamps, attached to an overhead ceiling support, from which four chains are suspended. A bracket is equidistantly attached to each chain, and a shelf platform rests thereupon. Additional sets of brackets and shelf platforms may be attached therebeneath.

U.S. Pat. No. 4,295,432 describes a hanging shelf assembly comprising a plurality of shelves, each shelf having a vertically disposed slot communicating with the exterior of the shelf near each of the four corners thereof, and four webbings, each inserted into one of the slots in vertically aligned relationship and attached to an upper end bar. Each slot is connected at right angles to a horizontal disposed slot terminating in a cylindrical recess into which a plug is inserted so that the web passes downwardly through the vertical slot into the horizontal slot, around the plug, back through the horizontal slot, and downwardly through the vertical slot.

U.S. Pat. No. 4,329,789 discloses a portable, lightweight, and compact food dryer, comprising a collapsing frame and tiers of lightweight trays enclosed by a net housing and covered by a heat absorbing roof. A metal hook protrudes vertically out of the apex of the roof and has a metal collar at its shank. A plurality of support straps are attached to the shank, pass over the collar and vertically down inside the net housing. All but the last tray are attached at regular intervals to the vertical straps.

U.S. Pat. No. 5,542,530 relates to adjustable shelving which may be suspended from a cross-member. Each shelf has at least four apertures through which respective vertical suspenders pass. A set of adjustable shelf fasteners, releasably attached to respective suspenders at the corner locations, is used to support each shelf.

These collapsible shelving units tend to operate satisfactorily while suspended from an overhead support, but they can be easily swung by a sidewise force, causing shelf contents to be disarranged or dislodged if not enclosed on all four sides by a bag or netting. Moreover, placing heavier loads on one side of the shelves can cause the entire unit to swing sidewise. There is accordingly a need for a device that can prevent sidewise swinging and maintain a shelving unit in upright relationship.

SUMMARY OF THE INVENTION

It is an object of this invention to provide a shelving assembly that is collapsible and easily erectable by a single person within a wardrobe frame.

It is additionally an object to provide a shelving assembly that is tautly stretched between horizontally disposed top and bottom members of the wardrobe frame.

It is also an object to provide a shelving assembly that keeps the upright poles of the wardrobe frame in tightly conjoined relationship.

This invention comprises engagement means for engaging top and bottom supports at four spaced-apart places defining a square or rectangular area equal to the area of a shelf, tensile support means having means for engaging each of the top and bottom engagement means, shelf support means attached to the tensile support means, a plurality of shelves that rest on the shelf support means, and means proximate each corner of the shelves for engaging the tensile support means.

More specifically, this invention comprises pre-assembled shelving that is collapsible or "knock down". The shelving assembly comprises four lengths of cord, eight hooks attachable at the ends of the cords, and a plurality of shelves having a slit leading to a hole near each of the four corners thereof.

A cord, having means for attaching the hooks at each end suitably a loop at each end and also having a plurality of staples athwart the cord at selected distances apart and from the loops, is inserted through the slits into corresponding holes of each shelf. The loops on the far sides of the shelves from the staples thereby become the upper loops, and the remaining loops become the lower loops.

Four of the hooks are placed over top frame members of a free standing storage closet or wardrobe frame at distances apart that correspond substantially to the openings in the shelves through which the cord passes, and an upper cord loop is engaged with each hook. The shelving assembly is thereby suspended, and the shelves rest upon the staples. The remaining four hooks are similarly placed over bottom frame members of the storage closet, and the remaining lower cord loops are engaged with the hooks. The top frame members temporarily bend sufficiently to permit this engagements but subsequently straighten to maintain reasonable cord tautness.

In the preferred embodiment of this invention, the cord selected is a filament polypropylene cord with a spun polyester core. The polyester core prevents the cord from having too much stretch and thus allows the shelving to remain taut. The frame is suitably constructed of tubular steel components. The tubes used in one embodiment of the invention have a diameter of 0.6280 inches and are 0.0235 gauge.

The cords are equal in length. The length selected is such that the cords are taut in the assembled closet or frame, and the distances between staples are selected so that the shelves are horizontally disposed, at a selected distance apart, and parallel to each other.

Tautness can be enhanced by replacing the S-links with hooks with rope grips. Although the embodiment illustrated herein utilizes S-links, hooks having rope grips or hooks affixed to the cords in any manner including snap hooks may also be used.

The staples (flat metallic pieces crimped onto the cords) are located at preselected distances on each of the cords and thereby define the level at which each of the shelves that rest thereon are located. Other means of supporting the shelves are suitable, including the use of knots in the cords, provided, of course, that such shelf supporting means are secure and will not move when the shelves are in use.

The objective of simplicity in securing the shelves and maintaining the shelves level is achieved by using hooks at both ends of the cords. Preferably, S-hooks, also known and referred to herein as S-links, engage the top and bottom sets of horizontal poles 13*a* and 13*b*.

Alternatively, a hook with rope grip can be used at either end of each of the cords or a turnbuckle or other tightening means can be used along the length of the cords in order to allow the user to make the cord taut after engagement of the hooks with the horizontal poles, thereby ensuring cord tautness and hence shelf stability.

Still another embodiment of the invention utilizes holes drilled into the shelves near the corners thereof, without slits to access the holes. The staples in this embodiment of the invention, however, must be added after the cords have been passed through these holes.

BRIEF DESCRIPTION OF THE DRAWINGS

FIG. 2 is a top view of a shelf having four notches, four slits, and four holes therein.

FIG. 3 is an expanded isometric view of one corner of a shelf that shows a notch, a slit, and a hole in detail.

FIG. 4 is a front view of a stretched cord, showing top and bottom loops, a tightening device, and a staple.

FIG. 5 is a front view of an S-hook.

DESCRIPTION OF THE PREFERRED EMBODIMENTS

Figure 1:
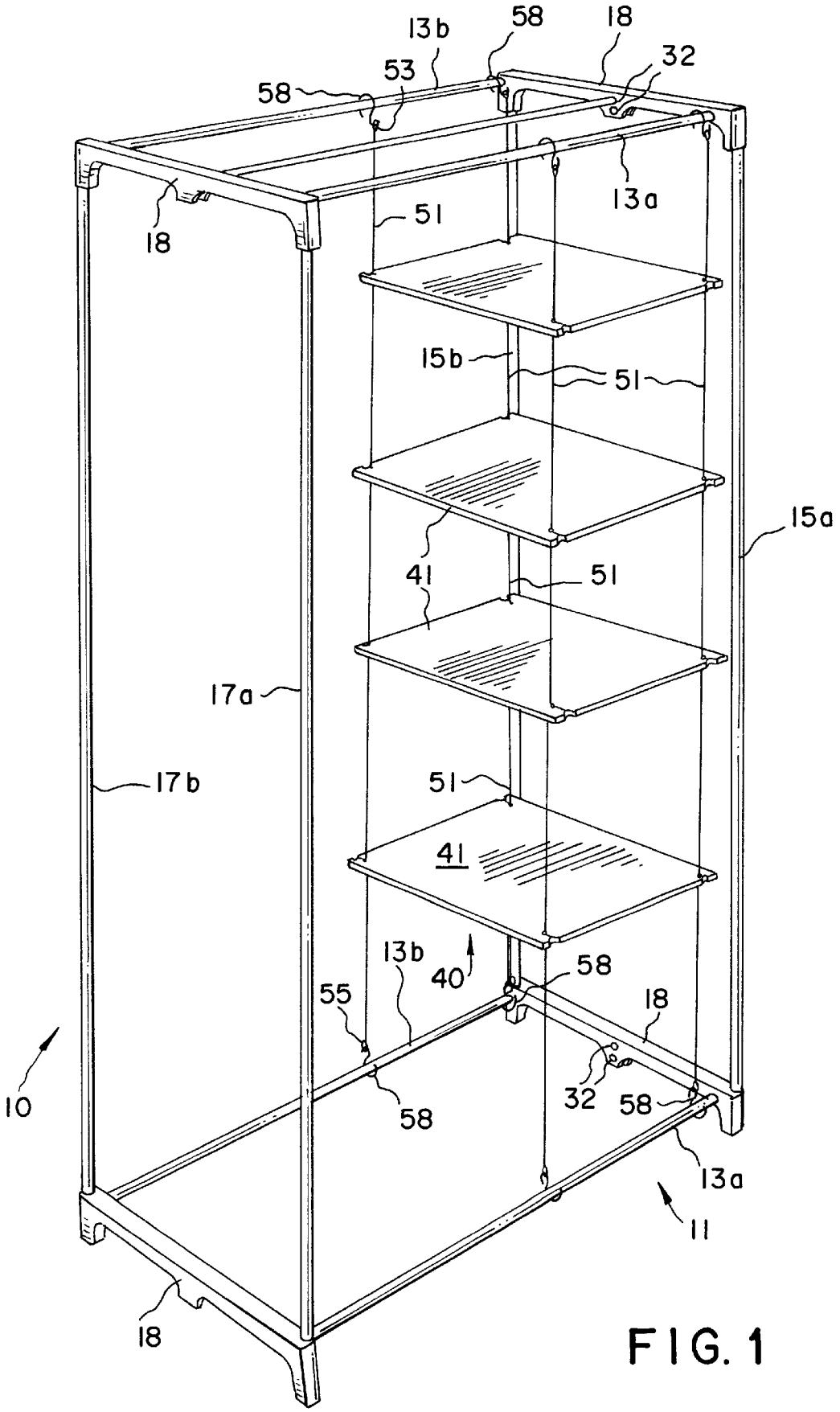
FIG. 1 is a perspective view of an assembled wardrobe frame without its cover and with the tautly mounted shelving assembly of this invention installed therein.

As shown in FIG. 1, assembled wardrobe frame 10 comprises a shelf section 11 in which the collapsible shelving of this invention is tautly mounted. Upright poles 15*a* and 15*b*, however, do not require perpendicularly disposed or obliquely disposed holes therein. Frame 10 comprises top and bottom corner connection pieces 18 having perpendicularly disposed holes in the ends thereof and horizontally disposed holes near these ends, upright poles 15*a*, 15*b* at the corners of shelf section 11 and upright poles 17*a*, 17*b* at the opposite corners that are inserted into the perpendicularly disposed holes, and horizontally extending poles 13*a*, 13*b* that are inserted into the horizontally disposed holes in the connection pieces.

Shelf assembly 40 comprises shelves 41, cords 51, S-hooks 58, and optional tightening device 59. Each S-hook 58 comprises a top distal crook 58(*a*) and a bottom distal crook 58(*b*). Shelves 41 have a notch 43 at each corner thereof, a slit 45 extending therefrom, and a hole 47 at the inner end of slit 45. Each cord 51 has a top loop 53, a bottom loop 55, a plurality of staples 57 at a selected distance apart, and optimally a tightening device 59.

A cord 51 is slid sidewise through each slit 45 into each hole 47 on a selected side of a staple 57, whereby the loop nearer to shelves 41 than staples 57 becomes top loop 53 and the loop nearer to staples 57 than shelves 41 becomes bottom loop 55.

Four hooks 58 are placed over upper poles 13*a*, 13*b* to define a square or rectangle corresponding to the size of shelves 41. Top loops 53 are engaged with these hooks 58, and shelving assembly 40 is allowed to hang down so that shelves 41 are parallel to each other.

The remaining four hooks 58 are pulled down and placed over lower poles 13*a*, 13*b*, and bottom loops 55 are engaged therewith, causing cords 51 to be tightly stretched. Tightening devices 59 may optionally be utilized to obtain increased tautness of cords 51.

In order to facilitate hook engagement and maintain the cords taut, the hooks are first engaged with the upper horizontal poles. Then the hooks at the other ends of the cords are pulled down and over the lower horizontal poles. In this way the distance between the interior surface of the top distal crook 58(*a*) and the interior of the bottom distal crook 58(*b*) corresponds substantially to the distance between the points where such crooks engage the horizontal poles.

Shelves 41 may be made of any suitable material, such as chipboard, dry-process hardboard, Masonite, and plywood. Cords 51 may be made of nylon, dacron, or any other material, with non-stretchable materials being preferred.

A horizontally extending pole 13*c* is inserted into horizontally disposed holes 32 in the central portions of connection pieces 18 to form a hanging pole that stretches across the upper end of the wardrobe skeleton. Hanging pole 13*c* does not interfere with shelving space above the upper shelf, reinforces the top of the wardrobe and provides a pole for hanging clothes next to the installed shelf assembly. It is apparent that numerous variations of the preferred embodiments described hereinbefore may be utilized. However, all such variations that are within the spirit and scope of the invention are deemed to be covered by the following claims.

What is claimed is:

1. A collapsible shelving assembly that is tautly suspended within an erected wardrobe frame said assembly comprising top and bottom hook means, tensile support means having means for engaging each of said top and bottom hook means, shelf support means attached to said tensile support means at selected distances apart, a plurality of shelves that rest on said shelf support means, and means proximate each corner of said shelves for engaging said tensile support means.

2. The assembly of claim 1, wherein said wardrobe frame comprises a shelf section in which said assembly is tautly suspended.

3. The assembly of claim 2, wherein said wardrobe frame comprises top and bottom corner connection pieces having perpendicularly disposed holes in the ends thereof and horizontally disposed holes near said ends.

4. The assembly of claim 3, wherein said wardrobe frame comprises upright poles at the corners of said shelf section and upright poles at the opposite corners of said frame that are inserted into said perpendicularly disposed holes in said top and bottom connection pieces.

5. The assembly of claim 4, wherein said wardrobe frame comprises horizontally extending poles that are inserted into said horizontally disposed holes in said connection pieces.

6. The assembly of claim 5, wherein a horizontally extending pole is inserted into horizontally disposed holes in a central portion of said top connection pieces to form a pole for hanging clothes in a clothes hanging section adjacent said shelf section.

7. The assembly of claim 6, wherein the tensile support means are cords and each of said plurality of shelves has openings proximate each corner thereof which are larger in diameter than said cords.

8. The assembly of claim 7, wherein said tensile support engaging means comprises a slit, near each corner of each said shelf, that extends inwardly from an edge of said shelf to one of said openings in the form of a vertically disposed hole.

9. The assembly of claim 8, wherein a notch is cut into each said edge from which each said slit extends.

10. The assembly of claim 9, wherein said hook means are S-shaped hooks.

11. The assembly of claim 7, wherein said tensile support means are nylon cords.

12. The assembly of claim 7, wherein said shelf support means are staples attached athwart said cords.

* * * * *